US005273461A

United States Patent [19]

Lee

[11] Patent Number: 5,273,461

[45] Date of Patent: Dec. 28, 1993

[54] ELECTRONIC CONNECTOR FOR ELECTRICALLY CONNECTING AN ELECTRONIC MODULE TO A PRINTED CIRCUIT BOARD

[76] Inventor: Chih-Ta Lee, Suite 1, 11F, 95-8 Chang Ping Road, Sec. 1, Taichung, Taiwan

[21] Appl. No.: 936,624

[22] Filed: Aug. 28, 1992

[51] Int. Cl.[5] ..... H01R 13/00

[52] U.S. Cl. ..... 439/637; 439/924

[58] Field of Search ..... 439/629–

[56] References Cited

U.S. PATENT DOCUMENTS

| | | | |
|---|---|---|---|
| 3,040,291 | 6/1962 | Schweitzer et al. | 439/637 |
| 3,289,148 | 11/1966 | Antes | 439/637 |
| 3,808,589 | 4/1974 | Bonhomme | 439/637 |
| 4,332,431 | 6/1982 | Bobb et al. | 439/637 |
| 5,052,953 | 10/1991 | Weber | 439/637 |
| 5,098,306 | 3/1992 | Noschese et al. | 439/637 |

*Primary Examiner*—Joseph H. McGlynn

[57] ABSTRACT

An electronic connector for electrically connecting an electronic module to a printed circuit board including a casing having crimped metal guide posts inserted into holes on the printed circuit board and a channel to receive the module to be connected, and pairs of first contacts and pairs of second contacts alternatively inserted in holes on the casing to hold down the module and electrically connect it to the printed circuit board, wherein each contact of the pairs of first contacts and the pairs of second contacts has an upper part bent outwards, and then extended downwards at a length stopped against an inside surface of the casing; a separating wall is formed between each two adjacent contacts and projects from the lowermost edge of the casing to separate the contacts.

3 Claims, 5 Drawing Sheets

ELECTRONIC CONNECTOR FOR ELECTRICALLY CONNECTING AN ELECTRONIC MODULE TO A PRINTED CIRCUIT BOARD

BACKGROUND OF THE INVENTION

In connecting a module to a printed circuit board or the mother board of an electric appliance, a connector shall be used. FIG. 1 illustrates a conventional connector for this purpose. As illustrated, the connector (2) has a channel (23) in longitudinal direction, which receives the module (1) to be connected, pairs of contacts bilaterally fastened inside the casing (21) thereof, which hold the module (1) in place and have each a tail (24) extended out of the casing (21), and two guide posts (22) projecting downwards on two opposite ends thereof. By inserting the guide posts (22) and the tails (24) of all contacts in respective holes on the printed circuit board, the connector (2) is connected in place. Once the module was inserted in the channel (23), the printed terminals (11) on the module (1) become respectively connected to the contacts of the connect (2), and therefore the module is electrically connected to the printed circuit board. Examples of the conventional contacts are shown in FIGS. 2 and 3. FIG. 2 illustrates a pair of first contacts (3) each having a clamping portion formed on its top portion. FIG. 3 illustrates a pair of second contacts 4 each having a clamping portion formed on its bottom portion. The first contacts (3) and the second contacts (4) are alternatively arranged in rows. Once the module (1) has been inserted in the channel (23), the paris of first contacts (3) clamp the upper part of the module (1) inside the channel (23), and the pairs of second contacts (4) clamp the lower part of the module (1) inside the channel (23), and therefore the module (1) becomes firmly retained in place and electrically connected to the printed circuit board below. As illustrated in FIG. 2, each first contact (3) is comprised of a tail (32) on the bottom end thereof connected to the printed circuit board below, a clamping portion (31) formed on an upper portion of the contacts having a stop end 34 formed on the top portion of the contact 3, and a supporting portion (33) on the middle between the tail (32) and the clamping portion (31). The supporting portion (33) has an upper portion obliquely extended upwards inwards towards the clamping portion (31) and a lower part obliquely extended downwards inwards, when positioned on the right side, or downwards outwards, when positioned on the left side, towards the tail (32) connected to a respective contact on the printed circuit below the connector. When assembled, the tail (32) is extended out of the bottom edge of the casing (21), the supporting portion (33) is stopped against the inside surface of the casing (21), the stop end (34) is stopped against a respective inside flange (23A) in the channel (23), and the clamping portion (31) projects into the channel (23). Once the module (1) was inserted into the channel (23), the clamping portion (31) is squeezed outwards causing each first contact (3) to produce a stress for firmly clamping the module (1) between the two contacts 3. Because each first contact (3) is simply supported in place at two bearing points, namely, the supporting portion (33) and the stop end (34), it may be displaced easily. More particularly, the free stop end (34) may be disconnected from the respective inside flange (23A) (see the dotted lines in FIG. 2). As illustrated in FIG. 3, each second contact (4) is comprised of a tail (42) on the bottom end thereof connected to the printed circuit board below the connector, a clamping portion (41) on the top end thereof projected into the channel (23), and a supporting portion (43) on the middle between the tail (42) and the clamping portion (41). The supporting portion (43) has an upper portion formed into a bend (44) obliquely extended downwards to connect the clamping portion (41) at a lower central end thereof, and a lower portion obliquely extended downwards inwards, when positioned on the right side, or downwards outwards, when positioned on the left side, and to connect the tail (42) connected to a respective contact on the printed circuit below the connector. Because a large angle is formed between the bend (44) and the clamping portion (41) and projected into the channel (23), the clamping portion (41) may be bent outwards (see the dotted lines in FIG. 3) or even broken when the module (1) was inserted into the channel (23). Similar to the first contacts (3), each second contact (4) is unstably supported in place at two bearing points, namely, the bend (44) and the supporting portion (43). In this structure of connector, the pitch between two adjacent contacts is about 0.3 m/m to 0.5 m/m. Therefore, residual tin solder (33;43) may be gathered around the tails (32;42) during the process of tin soldering, causing a short circuit across every two adjacent contacts 3, 4 (see FIG. 6). Still another disadvantage of this structure of connector (22) is that the guide posts (22) which are each integrally formed on the plastic casing (21), which may be broken easily during the installation of the connector.

SUMMARY OF THE INVENTION

The present invention eliminates the aforesaid disadvantages. According to one aspect of the present invention, each first contact has an upper part bent outwards, and then extended downwards at a length and to form a stop end stopped against an inside surface of the casing to support the clamping portion of the contact for firmly clamping the module. Therefore, the top end of each first contact does not displace as the module is loaded. According to another aspect of the present invention, the angle defined between the clamping portion of each second contact and the module inserted in the channel of the casing is minimized in order that the clamping portion will not be squeezed to deform as the module was inserted in the channel of the casing. According to still another aspect of the present invention, two clamping portions of the pair of second contacts are disposed at different levels to therefore greatly reduce the inserting force of the module. According to still another aspect of the present invention, a separating wall is formed between each two adjacent contacts and projects from the lowermost edge of the casing to separate the leg of one contact from another leg of another corresponding contact to preclude an accumulation of tin solder residue between two adjacent contacts to thereby prevent short circuit caused between the two adjacent contacts. According to a yet further aspect of the present invention, the guide posts of the casing are each formed with a crimped metal rod so that the guide posts can be firmly inserted in respective holes on the printed circuit board without being damaged.

DETAILED DESCRIPTION OF THE PREFERRED EMBODIMENT

Figure 1:
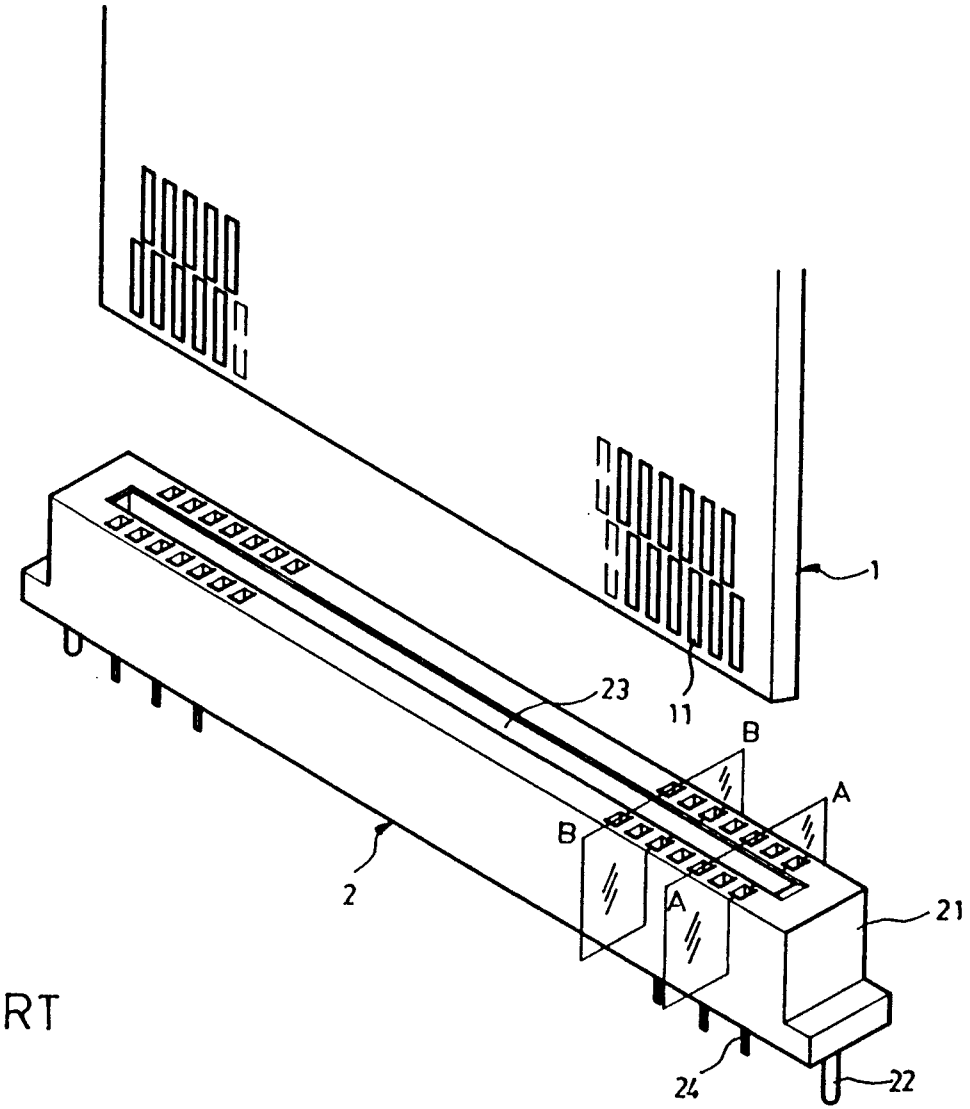
Fig. 1 PRIOR ART
FIG. 1 illustrates a conventional connector for connecting an electronic module to a printed circuit board.
Figure 3:
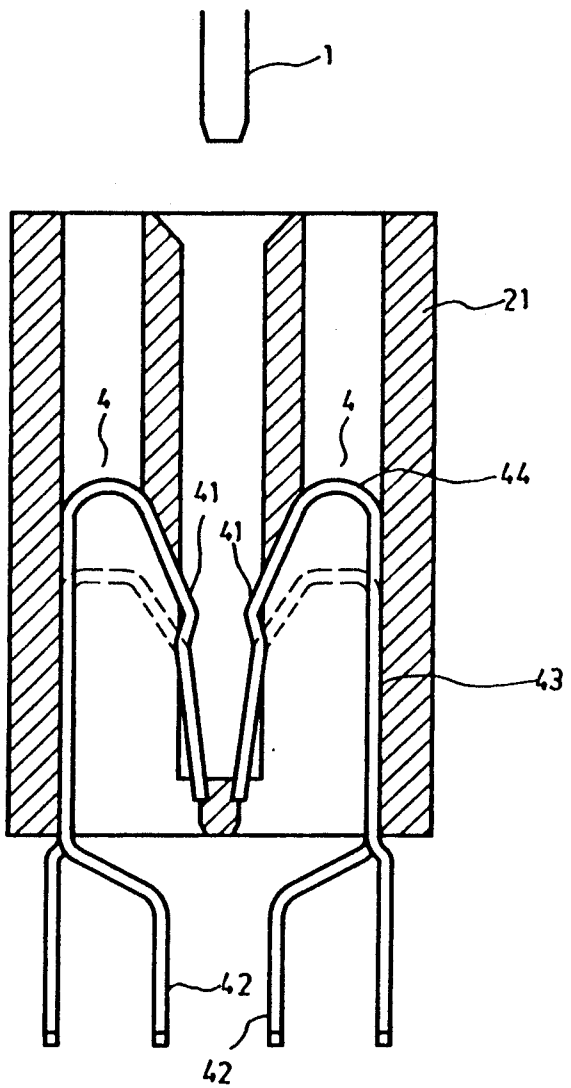
Fig. 3 PRIOR ART
FIG. 3 is a cross section taken on line B—B of FIG. 1 showing the structure of a second conventional contact.
Figure 2:
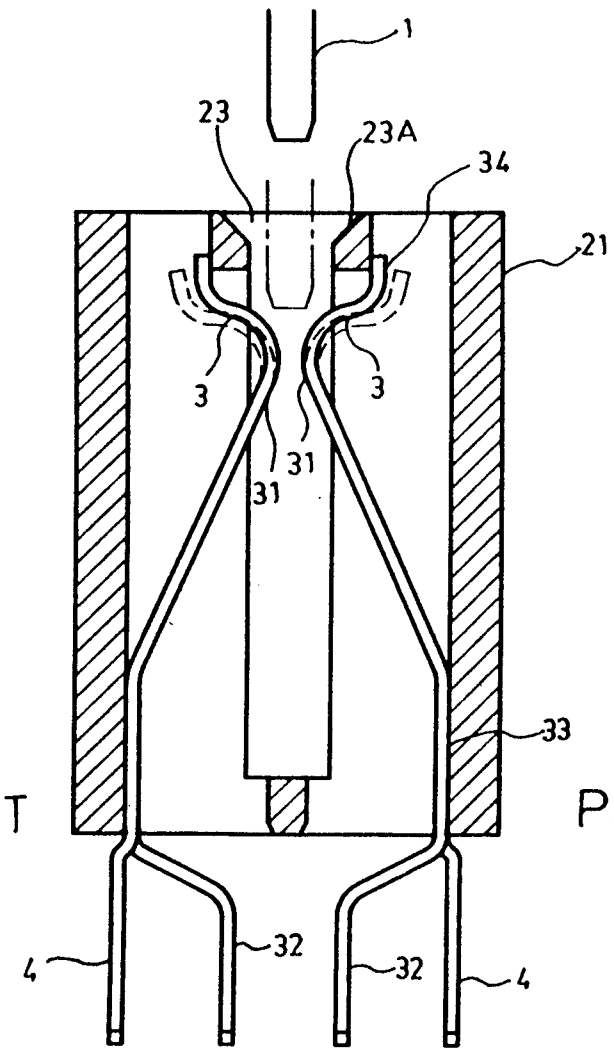
Fig. 2 PRIOR ART
FIG. 2 is a cross section taken on line A—A of FIG. 1 showing the structure of a first conventional contact.
Figure 5:
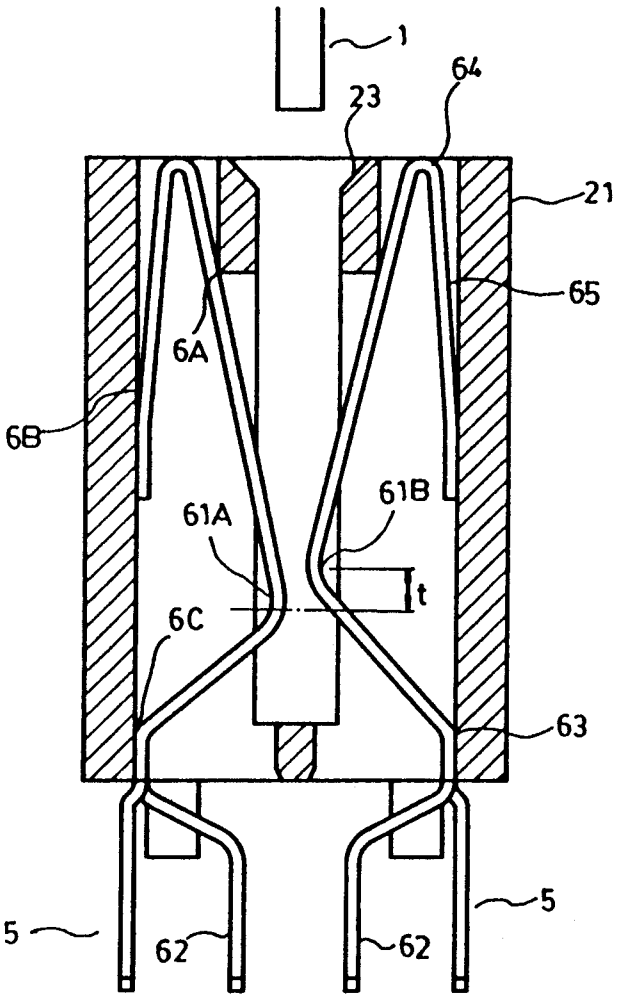
FIG. 5 is another cross section of the connector of FIG. 4 showing the structure of the second contacts therein.
Figure 7:
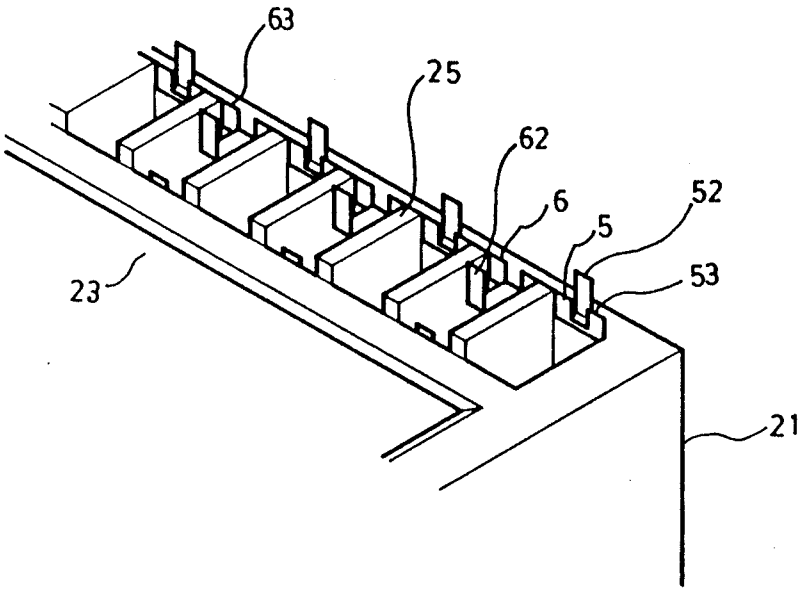
FIG. 7 is an illustration showing the arrangement of the leg portions of the first and second contacts on the bottom edge of the connector according to the present invention.
Figure 6:
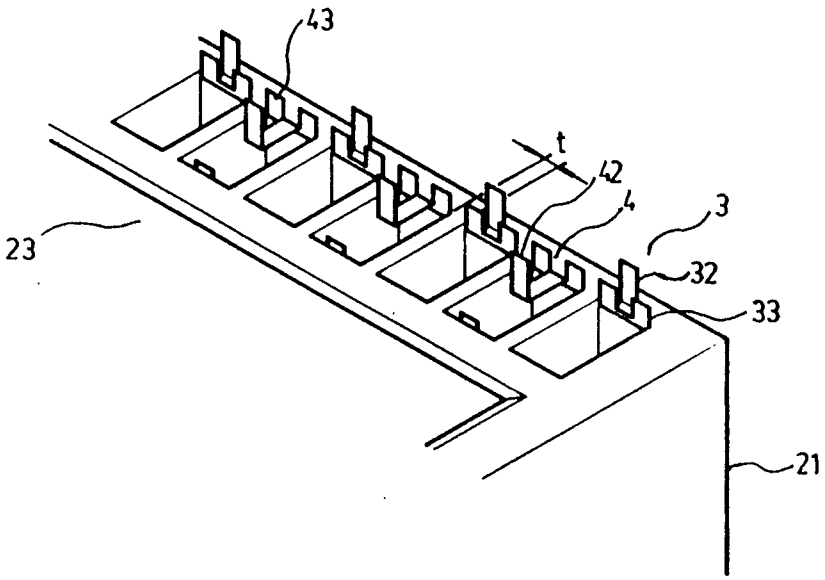
Fig. 6 PRIOR ART
FIG. 6 shows the arrangement of tails on the bottom edge of a conventional connector.
Figure 8:
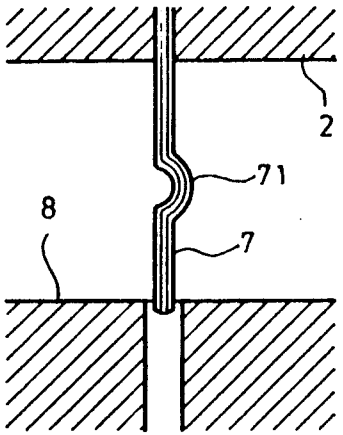
FIG. 8 shows the structure of a guide post according to the present invention.

A connector as constructed in accordance with the present invention has an outer appearance substantially as illustrated in FIG. 1. The improvements of the present invention is on the guide posts and the first and second contacts. FIG. 5 illustrates the structure of the firs contacts according to the present invention. FIG. 5 illustrates the structure of the second contacts according to the present invention. FIG. 7 illustrates the arrangement of the tails of the contacts on the same side. FIG. 8 illustrates the structure of the guide posts according to the present invention.

Figure 4:
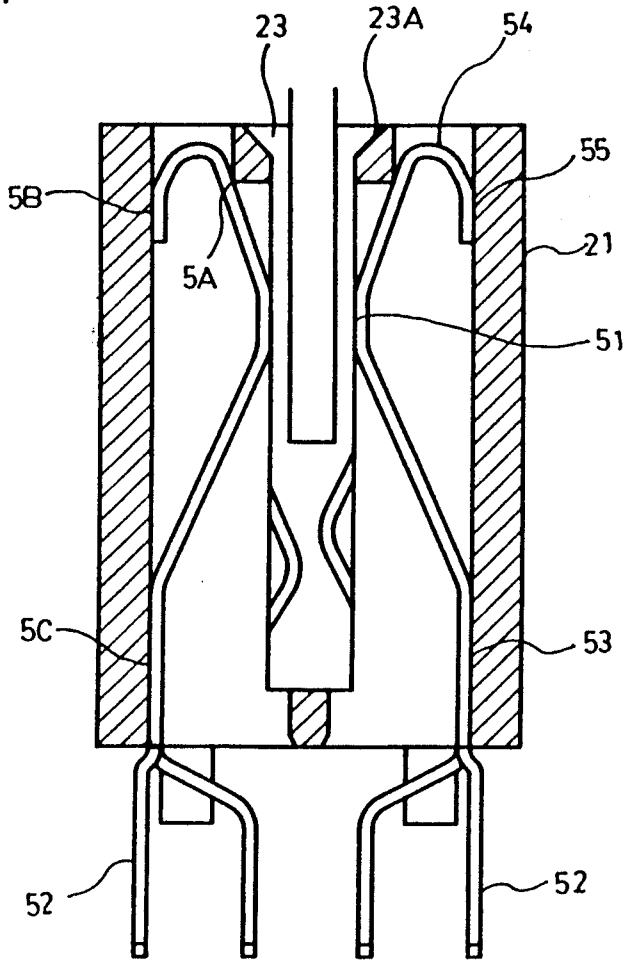
FIG. 4 is a cross section of a connector according to the present invention showing the structure of the first contacts therein.

Referring to FIG. 4, a first contact 5 according to the present invention is comprised of a clamping portion 51, a straight leg portion 52, a straight supporting portion 53 connected between the straight leg portion 52 and the clamping portion 51, a free retaining end portion 55, and a bend 54 connected between the clamping portion 51 and the free stop end 55. The supporting portion 53 is retained on either a right or a left inside surface of the casing 21, and has an upper portion of the supporting portion 53 obliquely extended upwards inwards and to be connected with the clamping portion (51) and a lower portion of the supporting portion 53 obliquely extended downwards inwards, when positioned on the right side, or downwards outwards, when positioned on the left side, and to be connected with the leg portion 52. The clamping portion 51 is concaved inwardly towards a central portion of the channel 23 for clamping the module in cooperation with the other clamping portion 51 of the other corresponding contact 5, and has a bottom end obliquely extended downwards outwards to be connected with the straight supporting portion 53 and an upper portion obliquely extended upwards outwards from the clamping portion 51 to be stopped against the bottom corner of a respective inside flange 23A on either side of the channel 23 to connect the bending portion 54 having one end portion of the bending portion 54 obliquely extended downwards inwards to be connected with the clamping portion 51 and having the other end portion obliquely extended downwards outwards to be terminated with the straight free retaining end portion 55 which is retained on an inside surface of the casing 21. After the module 1 was inserted in the channel 23, the clamping portion 51 is supported in the casing 21 at three bearing points 5A, 5B and 5C to allow the two contacts 5 to firmly clamp the module 1.

Referring to FIG. 5, a second contact 6 juxtapositional and adjacent to the first contact 5 according to the present invention is comprised of a clamping portion 61A or 61B projected into the channel 23, a leg portion 62 on the bottom end thereof, a supporting portion 63 stopped against the inside surface of the casing 21 and having a bottom end curved downwards inwards or outwards and terminated with the leg portion 62 and an upper portion concaved inwardly in the channel 23 to form the clamping portion 61A or 61B, a bending portion 64 having one end obliquely extended downwards inwards to be connected with the clamping portion 61A or 61B and an opposite end obliquely extended downwards outwards to be terminated with a free retaining end portion 65. When assembled, the two clamping portions 61A, 61B of the two opposite second contacts 6 are disposed at different heights for an easy insertion of the module 1 in between the two clamping portions 61A, 61B (as shown in "t" in FIG. 5). After the module 1 was inserted in the channel, each second contact 6 is supported in the casing 21 at three bearing points 6A, 6B and 6C to firmly hold down the module 1.

Referring to FIG. 7, a separating wall 25 is formed between each two adjacent contacts 5, 6 and protrudes downwardly from the bottom edge of the casing 21 to separate the leg portion 52 of the first contact 5 from the leg portion 62 of the second contact 6, to prevent accumulation of tin solder residue between two adjacent leg portions 52, 62 to prevent a short circuit therebetween.

Referring to FIG. 8, a guide post 7 according to the present invention is formed with a crimped metal rod having a curved middle portion 71. When inserted into a pin hole on the printed circuit board 8, the curved middle portion 71 is tightly stopped in place, and therefore the guide post 7 will not be broken easily.

As indicated, the present invention is to provide a connector for connecting an electronic module to a printed circuit board which is durable in use, easy to install, and can firmly hold down the module to be connected.

It shall be understood that the present invention is not limited to the embodiment shown by way of example and that deviations from this embodiment are possible without exceeding the scope of the invention.

I claim:

1. A connector for electrically connecting an electronic module to a printed circuit board comprising a casing having a channel longitudinally recessed in said casing for receiving the module to be connected, and two rows of holes in communication with said channel disposed on two opposite sides of said channel, a plurality of pairs of first contacts and a plurality of pairs of second contacts alternatively inserted in said rows of holes to respectively clamp the module with each pair of said first contacts operatively contacting a first portion of said module, and with said pair of said second contacts juxtapositional and adjacent to said pair of said first contacts for operatively contacting a second portion of said module positioned below said first portion of said module to a printed circuit positioned below said connector, wherein each said contact of said pairs of said first contacts and said pairs of said second contacts including a clamping portion having an upper portion of said clamping portion bent outwards, and then extended downwards at a length to form a free retaining end portion to be stopped against an upper portion of an inside surface of said casing and having a lower portion of said clamping portion protruding downwardly obliquely to form a supporting portion to be retained on a lower portion of said inside surface of said casing and a leg portion protruding downwardly from said supporting portion to be connected with said printed circuit below said connector, each said contact having each said clamping portion concaved inwardly towards a central portion of said channel in said casing to allow one said clamping portion of one said contact to clamp said module in cooperation with the other said clamping portion of the other said contact, said pair of said second contacts having two respective said clamping portions of said second contacts disposed at different heights for an easy insertion of said module downwardly into said pair of said second contacts to be firmly clamped by said contacts.

2. A connector according to claim 1, wherein a separating wall is formed between each said pair of said first contacts and each said pair of said second contacts adjacent to said first contacts, with said separating wall protruding downwardly from a bottom edge of said casing to separate said first contacts and said second contacts.

3. A connector according to claim 1 wherein said casing has a plurality of guide posts formed on a bottom of said casing respectively formed with metal rods, each said guide post having a curved portion formed thereon to be tightly stopped in a respective pin hole in a printed circuit board to which the module is to be connected.

* * * * *